US010117482B2

(12) United States Patent
Chang

(10) Patent No.: US 10,117,482 B2
(45) Date of Patent: Nov. 6, 2018

(54) WEARABLE ELECTRONIC DEVICE

(71) Applicant: Climax Technology Co., Ltd., Taipei (TW)

(72) Inventor: Michael Chang, Hsinchu (TW)

(73) Assignee: CLIMAX TECHNOLOGY CO., LTD., Taipei (TW)

( * ) Notice: Subject to any disclaimer, the term of this patent is extended or adjusted under 35 U.S.C. 154(b) by 91 days.

(21) Appl. No.: 14/927,791

(22) Filed: Oct. 30, 2015

(65) Prior Publication Data

US 2017/0123070 A1 May 4, 2017

(51) Int. Cl.
*A44C 5/00* (2006.01)
*A44C 5/14* (2006.01)

(52) U.S. Cl.
CPC ..... *A44C 5/145* (2013.01)

(58) Field of Classification Search
CPC ..... A45C 11/00; A45C 2011/002; A45C 2011/003; A45F 5/00; A44C 5/145
USPC ..... 224/152, 576
See application file for complete search history.

(56) References Cited

U.S. PATENT DOCUMENTS 3,214,685 A * 10/1965 Brenner ..... A44C 5/14 224/152
4,382,318 A * 5/1983 Takimoto ..... A44C 5/2042 24/188
5,259,540 A * 11/1993 Kocznar ..... A44C 5/0015 224/164
5,735,629 A * 4/1998 Sakamoto ..... A44C 5/2052 24/265 B
6,168,055 B1 * 1/2001 Grados ..... G04B 37/1486 224/152
6,435,709 B2 * 8/2002 Hirano ..... A44C 5/14 224/164
2002/0101788 A1 * 8/2002 Petsch ..... A44C 5/24 368/281
2008/0106980 A1 * 5/2008 Guillaume ..... G04B 37/1486 368/282
2012/0168471 A1 * 7/2012 Wilson ..... A45F 5/00 224/152

* cited by examiner

*Primary Examiner* — Peter Helvey
(74) *Attorney, Agent, or Firm* — McClure, Qualey & Rodack, LLP

(57) ABSTRACT

A wearable electronic device is provided, including a main body, a flexible member, a connecting member, and a first hinge. The connecting member is connected to the flexible member and has a hook portion. The first hinge is disposed on the main body and detachably engaged with the hook portion, such that the connecting member is pivotally connected to the main body.

11 Claims, 9 Drawing Sheets

WEARABLE ELECTRONIC DEVICE

BACKGROUND OF THE INVENTION

Field of the Invention

Aspects of the present invention relate generally to electronic devices, and more particularly, to wearable electronic devices having a detachable connecting member.

Description of the Related Art

Conventional wearable electronic devices, such as smart watches or smart wristbands, usually have an undetachable flexible portion for wearing on the wrist. However, it might be uncomfortable and inconvenient for the users under long term usage. Hence, designing a mechanism of the wearable electronic device to facilitate a comfortable and flexible usage has become a critical issue in the related fields.

BRIEF SUMMARY OF THE INVENTION

In one exemplary embodiment, a wearable electronic device is provided in the invention. The wearable electronic device includes a main body, a flexible member, a connecting member, and a first hinge. The connecting member is connected to the flexible member and has a hook portion. The first hinge is disposed on the main body and detachably engaged with the hook portion, such that the connecting member is pivotally connected to the main body.

In one exemplary embodiment, a wearable electronic device assembly is provided in the invention. The wearable electronic device assembly includes a main body, a first connecting member, a watchband connected to the first connecting member, a second connecting member, and a necklace strap, connected to the second connecting member. The main body is alternatively connected to the first connecting member or the second connecting member, to be worn on the wrist of a user by the watchband or worn on the neck of the user by the necklace strap.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

While the invention has been described in connection with various aspects, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

In the following detailed description of the preferred embodiments, reference is made to the accompanying drawings which form a part hereof, and in which are shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting.

Figure 1A:
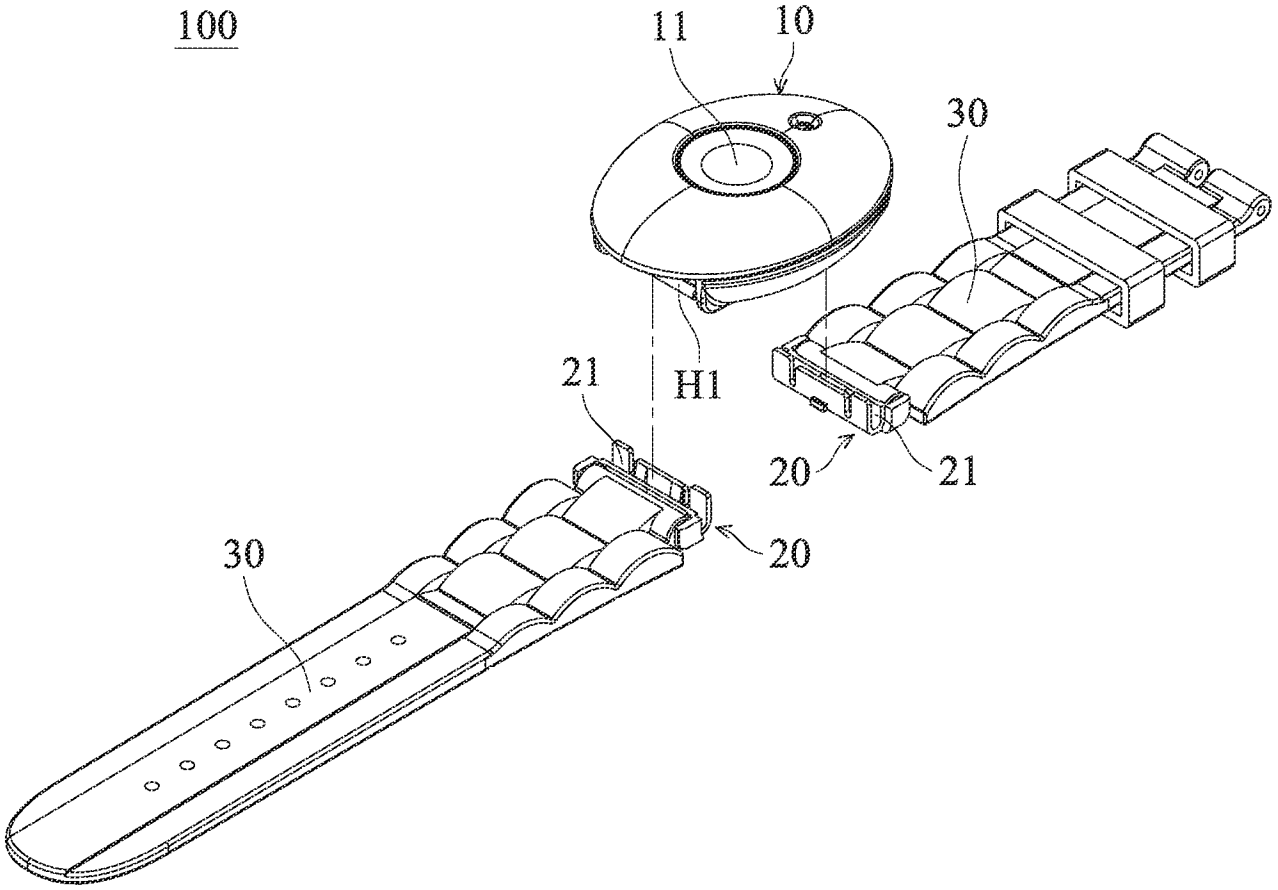
FIGS. 1A and 1B are exploded diagram of a wearable electronic device according to one embodiment of the invention.
Figure 1B:
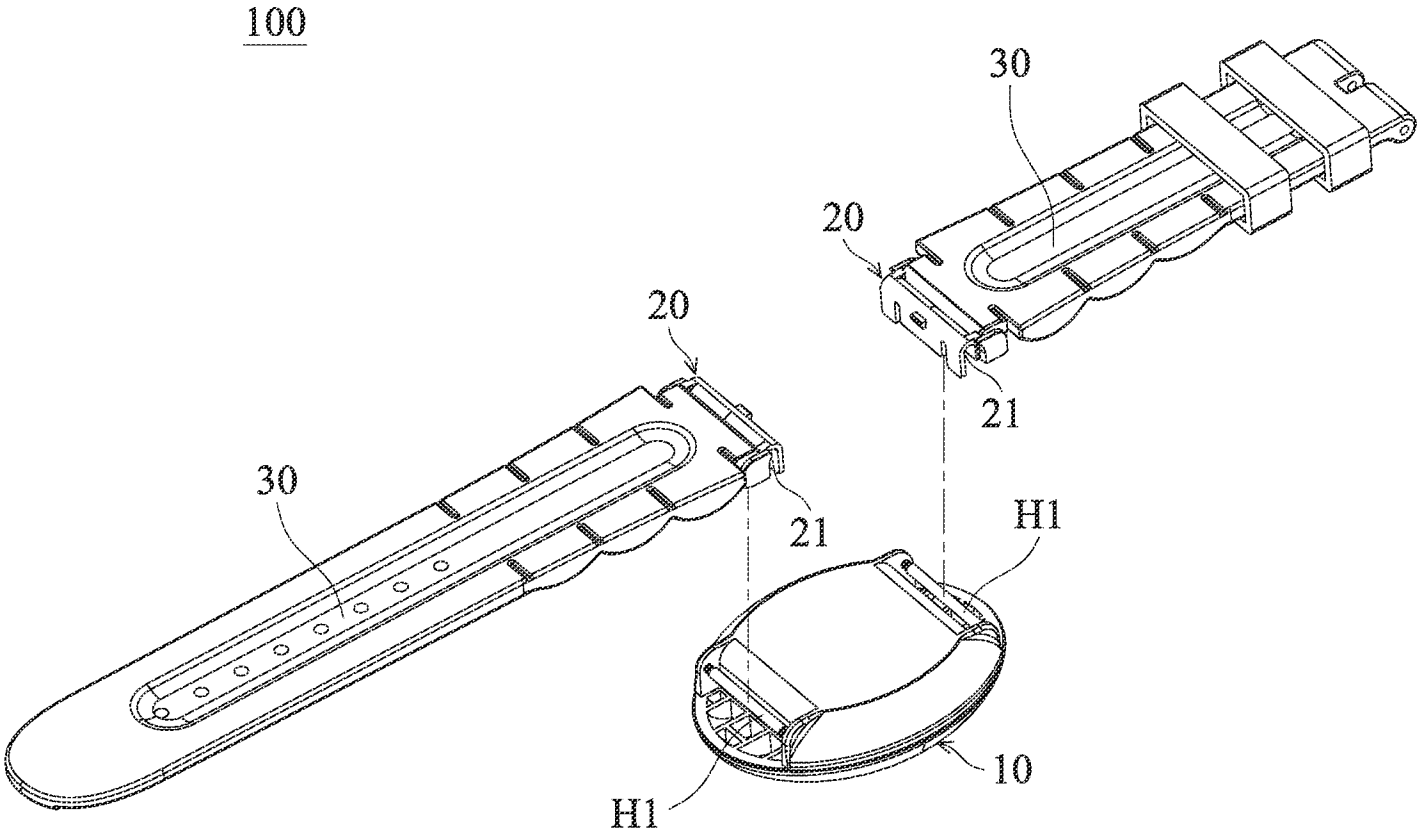
Figure 2A:
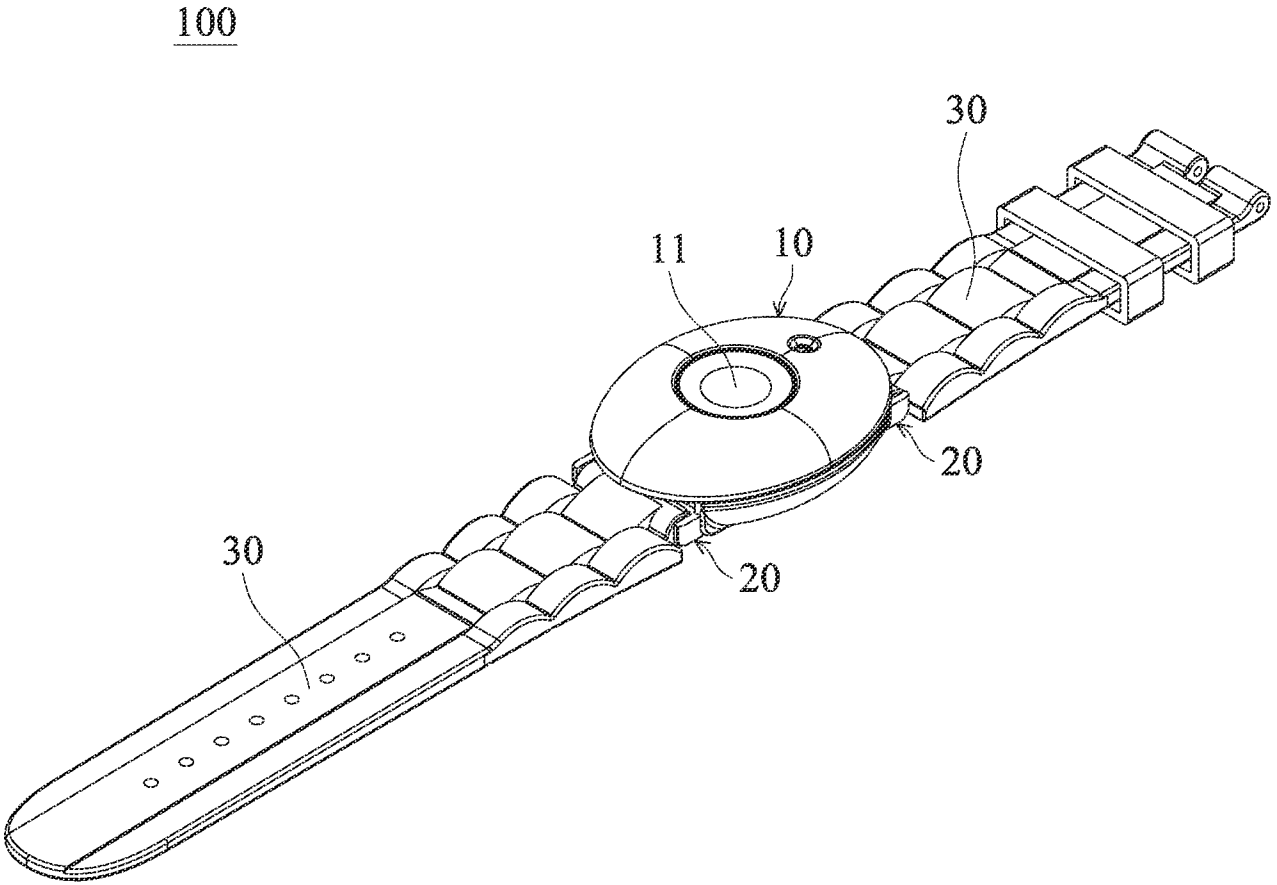
FIGS. 2A and 2B are perspective diagrams of the wearable electronic device of FIGS. 1A and 1B after assembly.
Figure 2B:
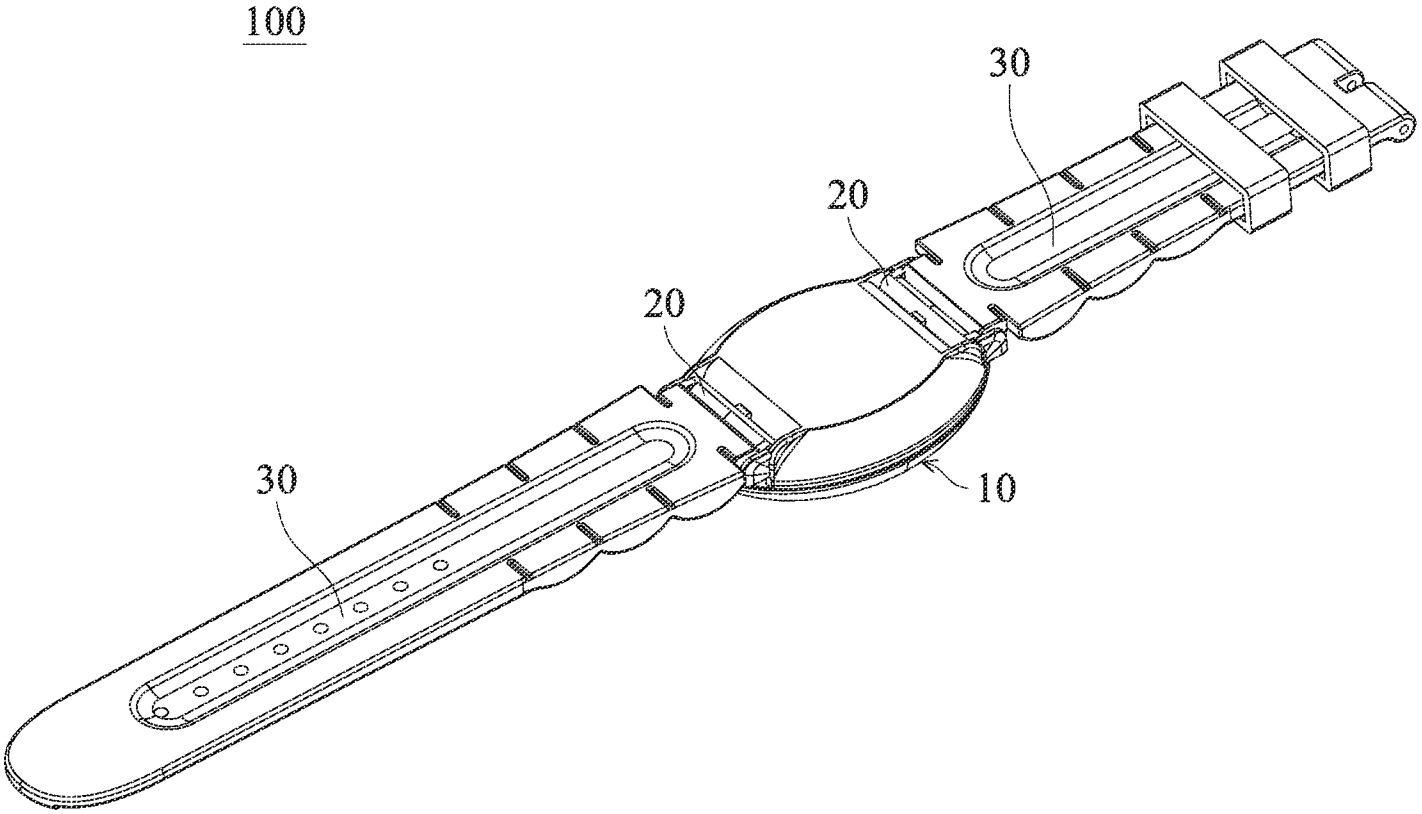

Referring to FIGS. 1A-1B and 2A-2C, an embodiment of a wearable electronic device may be a global positioning system (GPS) tracker, primarily comprising a main body 10, two connecting members 20, two flexible members 30, and two first hinges H1 pivotally connecting the flexible members 30 and the connecting members 20 with the main body 10. As shown in FIGS. 1A and 2A, the main body 10 has a button 11 on an upper surface thereof. In this embodiment, the main body 10 may have a processing unit and a global positioning system (GPS) receiver to provide position, velocity, and timing information. When the user needs help and pushes the button 11, a tracking transmitter in the main body 10 can broadcast a location signal or an emergency signal, such that the user can be found quickly and safely.

As depicted in FIG. 1B, each of the connecting members 20 is connected to an end of a flexible member 30 and forms a hook portion 21. The two first hinges H1 are disposed on opposite sides of the main body 10 and detachably engaged in the hook portions 21 of the connecting members 20, respectively, such that the connecting members 20 and the flexible member 30 can be pivotally connected to the main body 10 from opposite sides. In a normal usage, the two flexible members 30 may be utilized as watchbands, such that the electronic device can be worn on the wrist. In some embodiments, the wearable electronic device may have only one flexible member 30 detachably connected to first hinges H1 on the opposite sides of the main body 10 through the connecting members 20.

Figure 2C:
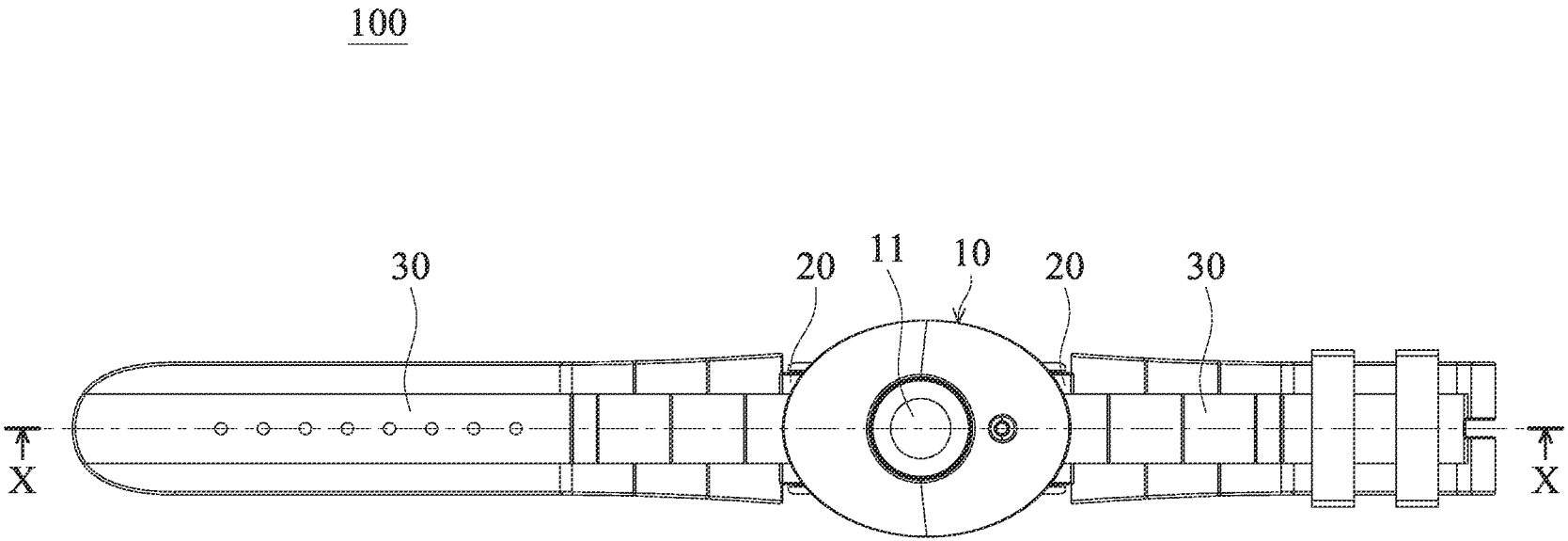
FIG. 2C is a front view of the wearable electronic device of FIGS. 2A and 2B.
Figure 3A:
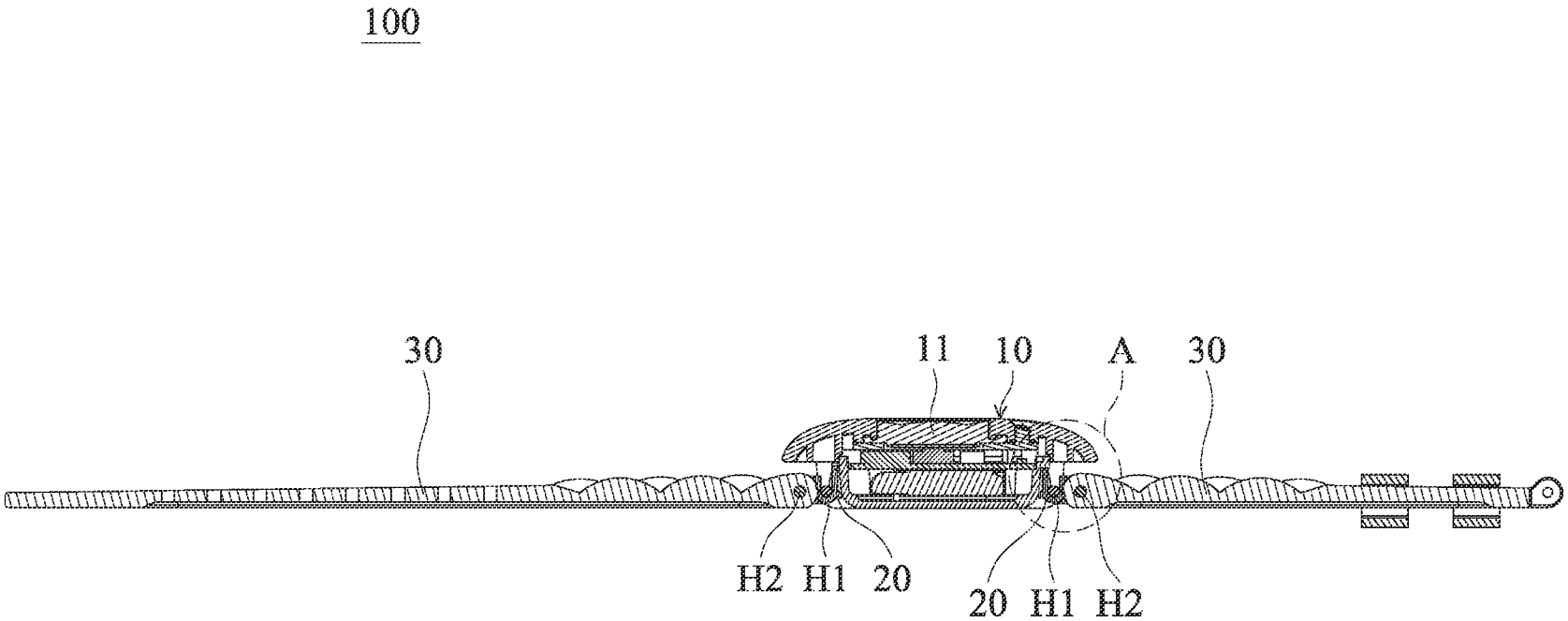
FIG. 3A is a sectional view along line X-X in FIG. 2C.
Figure 3B:
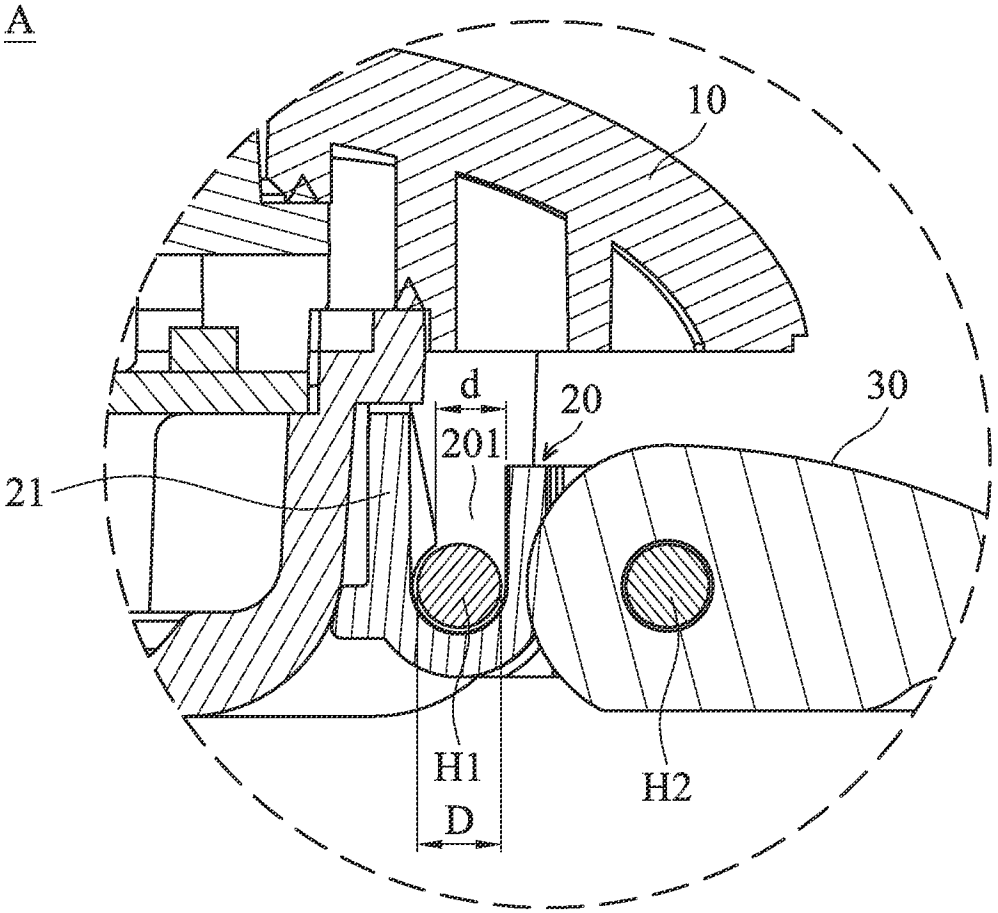
FIG. 3B is an enlarged view of portion A in FIG. 3A.

FIG. 3A is a sectional view along line X-X in FIG. 2C, and FIG. 3B is an enlarged view of portion A in FIG. 3A. Referring to FIGS. 3A and 3B, each of the connecting members 20 in this embodiment is pivotally connected to the flexible member 30 through a second hinge H2, wherein an opening 201 of the hook portion 21 has a minimum width d less than a diameter D of the first hinge H1 (FIG. 3B).

Figure 3D:
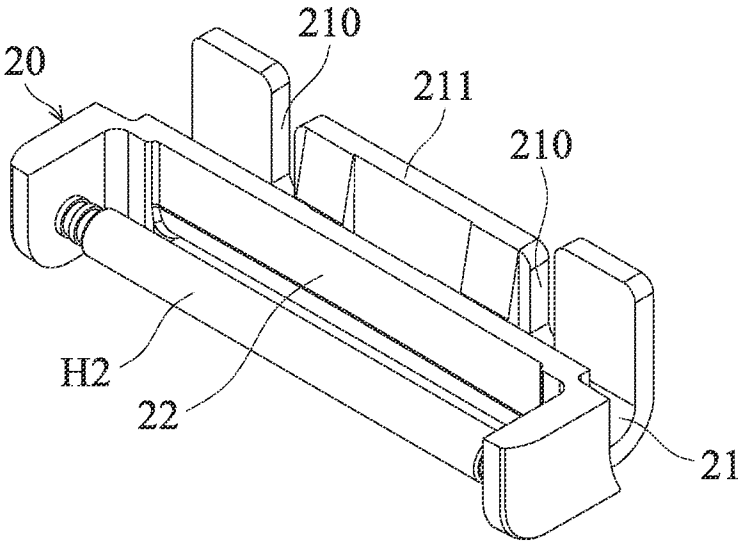
FIGS. 3C and 3D are perspective diagrams of the connecting member according to one embodiment of the invention.
Figure 3C:
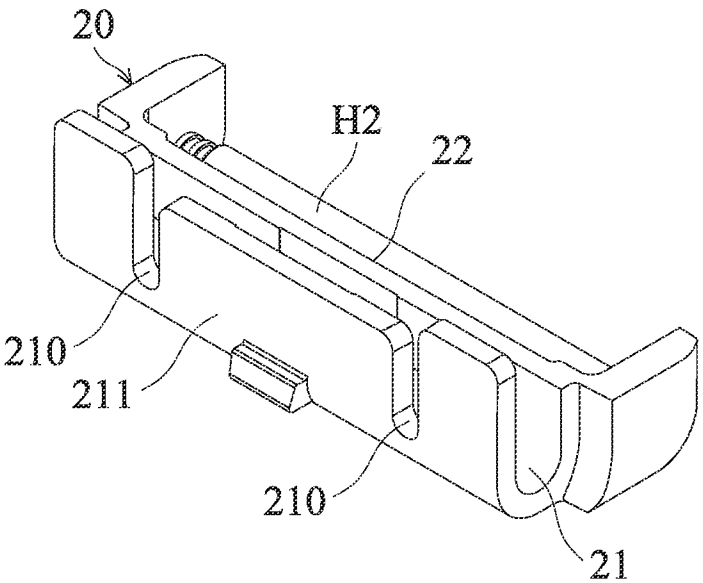

As shown in FIGS. 3C and 3D, the hook portion 21 of the connecting member 20 has two slots 210 with a flexible structure 211 formed therebetween. When engaging the first hinge H1 into the hook portion 21 during assembly, the flexible structure 211 may slightly deforms to allow the first hinge H1 to slide through the opening 201, such that the first hinge H1 can be firmly retained in the hook portion 21. Moreover, as shown in FIGS. 3C and 3D, the connecting member 20 further forms a U-shaped recess 22 adjacent to the hook portion 21 for accommodating the second hinge H2, wherein the recess 22 faces toward the flexible member 30, and the hook portion 21 faces upwardly toward the upper surface of the main body 10 (FIGS. 3A and 3B).

Figure 4B:
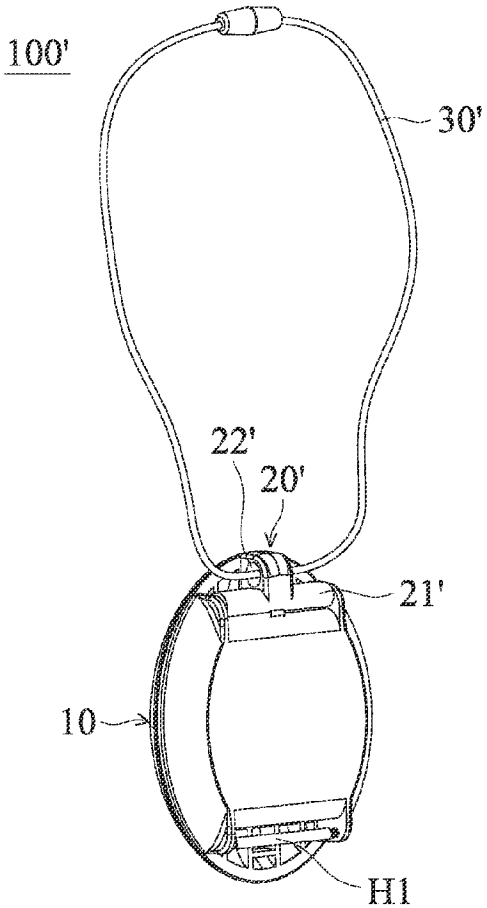
FIG. 4B is a perspective diagram of the wearable electronic device of FIG. 4A after assembly.
Figure 4A:
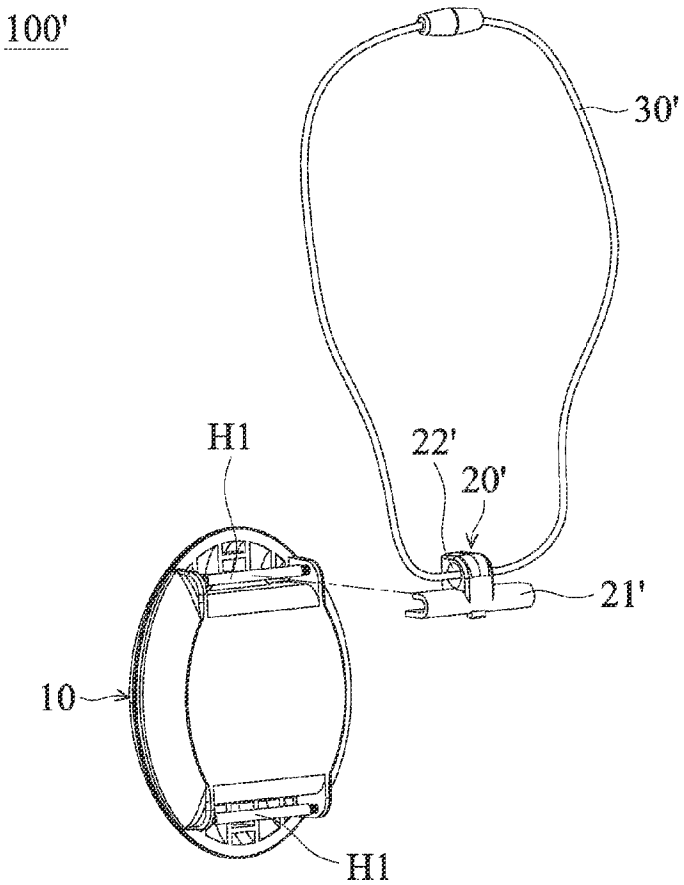
FIG. 4A is an exploded diagram of a wearable electronic device according to another embodiment of the invention.

Since the connecting members 20 and the flexible members 30 are detachable from the first hinges H1, the user may consider replacing the connecting members 20 and the flexible members 30 by a different type of connecting member 20' and flexible member 30', as the wearable electronic device 100' shows in FIGS. 4A and 4B. In this embodiment, the connecting member 20' has a hook portion 21' and a through hole 22', wherein the hook portion 21' is detachably engaged with the first hinge H1, as well as the hook portion 21 shows in FIGS. 3A and 3B. It is noted that the flexible member 30' may be a necklace strap extended through the through hole 22', such that the electronic device can be worn on the neck for convenient usage.

In summary, the disclosure provides a wearable electronic device assembly including a main body (such as a GPS tracker), at least a first hinge disposed on the main body, and at least two types of flexible members, such as watchband or necklace strap. When applying the watchband to the main body, a first type of connecting member can be utilized to engage with the first hinge, so as to pivotally connect the watchband with the main body for wearing on the wrist. Alternatively, when applying the necklace strap to the main body, a second type of connecting member can be utilized to engage with the first hinge, and the necklace strap is extended through the connecting member for wearing on the neck.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A wearable electronic device, comprising:

a main body;

a flexible member;

a connecting member, connected to the flexible member and having a hook portion and a U-shaped recess adjacent to each other, wherein the hook portion faces toward an upper surface of the main body in a vertical direction, and the recess faces toward the flexible member in a horizontal direction perpendicular to the vertical direction, wherein a sidewall of the hook portion serves as a bottom of the recess;

a first hinge, disposed on the main body and detachably engaged with the hook portion, such that the connecting member is pivotally connected to the main body; and a second hinge received in the recess, wherein the connecting member is pivotally connected to the flexible member via the second hinge.

2. The wearable electronic device as claimed in claim 1, wherein an opening of the hook portion has a minimum width less than a diameter of the first hinge.

3. The wearable electronic device as claimed in claim 1, wherein the first hinge is pivotally received in the hook portion.

4. The wearable electronic device as claimed in claim 1, wherein the connecting member is pivotally connected to the flexible member.

5. The wearable electronic device as claimed in claim 1, wherein the hook portion has two slots with a flexible structure formed therebetween for retaining the first hinge in the hook portion.

6. The wearable electronic device as claimed in claim 1, wherein the main body has a global positioning system (GPS) receiver that provides position, velocity, or timing information.

7. The wearable electronic device as claimed in claim 1, wherein the main body has a tracking transmitter broadcasting a location signal or an emergency signal.

8. The wearable electronic device as claimed in claim 1, wherein the main body has a button on an upper surface thereof.

9. The wearable electronic device as claimed in claim 1, wherein the flexible member is a watchband.

10. The wearable electronic device as claimed in claim 1, wherein the connecting member further has a through hole with the flexible member extended therethrough.

11. The wearable electronic device as claimed in claim 10, wherein the flexible member is a necklace strap.

* * * * *